US007558716B2

(12) United States Patent
Hammond

(10) Patent No.: US 7,558,716 B2
(45) Date of Patent: Jul. 7, 2009

(54) METHOD AND SYSTEM FOR ESTIMATING THE AMOUNT OF SUPERCHARGING IN A FORMATION

(75) Inventor: Paul Hammond, Bourne (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 382 days.

(21) Appl. No.: 11/254,459

(22) Filed: Oct. 20, 2005

(65) Prior Publication Data

US 2006/0129365 A1 Jun. 15, 2006

(30) Foreign Application Priority Data

Oct. 22, 2004 (GB) ..... 0423461.3

(51) Int. Cl.
*G06F 7/48* (2006.01)
*G06F 17/10* (2006.01)

(52) U.S. Cl. ..... 703/10; 703/2; 702/12; 73/152.51

(58) Field of Classification Search ..... 703/2, 703/10; 702/6, 7, 11, 12; 73/152.51
See application file for complete search history.

(56) References Cited

U.S. PATENT DOCUMENTS

| | | | | |
|---|---|---|---|---|
| 3,934,468 | A | 1/1976 | Brieger | |
| 4,860,581 | A | 8/1989 | Zimmerman et al. | |
| 5,233,866 | A | 8/1993 | Desbrandes | |
| 5,602,334 | A | 2/1997 | Proett et al. | |
| 5,644,076 | A | 7/1997 | Proett et al. | |
| 5,789,669 | A | 8/1998 | Flaum | |
| 7,031,841 | B2 * | 4/2006 | Zazovsky et al. | 702/12 |
| 7,243,537 | B2 * | 7/2007 | Proett et al. | 73/152.51 |
| 7,277,796 | B2 * | 10/2007 | Kuchuk et al. | 702/7 |
| 2003/0098156 | A1 | 5/2003 | Follini et al. | |
| 2005/0171699 | A1 | 8/2005 | Zazovsky et al. | |

FOREIGN PATENT DOCUMENTS

| | | |
|---|---|---|
| EP | 0 897 049 B1 | 9/2004 |
| GB | 2 410 511 A | 8/2005 |

OTHER PUBLICATIONS

Proett et al., Supercharge Pressure Compensation Using a New Wireline Testing Method and Newly Developed Early Time Sperical Flow Model, SPE 36524, 1996, pp. 329-342.*

(Continued)

*Primary Examiner*—Russell Frejd
(74) *Attorney, Agent, or Firm*—Michael Ford; James McAleenan; Jody DeStefanis

(57) ABSTRACT

A method is provided for estimating the amount of supercharging in a formation penetrated by a wellbore. According to the method, pressure fluctuation measurements are obtained at a position in the formation accessible from the well bore and at an adjacent position in the wellbore, and a model is provided which relates variations in pressure with time at these positions to one or more adjustable parameters from which the amount of supercharging can be estimated. The or each parameter is then adjusted to optimize the fit between the pressure variations predicted by the model and the measured pressure fluctuations, and the amount of supercharging is estimated from the adjusted parameter(s).

15 Claims, 11 Drawing Sheets

OTHER PUBLICATIONS

Abramowitz Bessel functions of integer order Handbook of mathematical functions: with formulas, graphs and mathematical tables (edited by Abramowitz and Stegun), Dover Publications, 1972, pp. 374-375.

Carslaw et al The region bounded internally by the circular cylinder Conduction of heat in solids, 2nd edition, Clarendon Press, 1959, pp. 334-339, section 13.5.

Fordham et al The principle of a critical invasion rate and its implications for log interpretation SPE 66th Annual Technical Conference and Exhibition, Dallas, Texas, U. S. A. Oct. 6-9, 1991, SPE paper 22539.

Frank et al Field experience with a new formation pressure testing-during-drilling tool IADC /SPE Drilling Conference, Dallas, Texas, U.S.A., Mar. 2-4, 2004, SPE paper 87091.

Hammond et al Correcting supercharging in formation-pressure measurements made while drilling SPE Annual Technical Conference and Exhibition, Dallas, Texas, Oct. 9-12, 2005, SPE paper 95710.

Longis et al An LWD formation pressure test tool (DFT) refined the Otter field development strategy IADC/SPE Drilling Conference, Dallas, Texas, U.S.A., Mar. 2-4, 2004, SPE paper 87092.

Meeten et al The hydraulic permeability of bentonite suspensions with granular inclusions Chemical Engineering Science, vol. 49, No. 19, 1994, pp. 3249-3256.

Meister et al Formation pressure testing during drilling: challenges and benefits SPE Annual Technical Conference and Exhibition, Denver, Colorado, U.S.A., Oct. 5-8, 2003, SPE paper 84088.

Parkes et al New techniques in wireline formation testing in tight reservoirs SPE Asia Pacific Oil and Gas Conference and Exhibition, Perth, Australia, Oct. 12-14, 1998, SPE paper 50128.

Phelps et al The effect of filtrate invasion and formation wettability on repeat formation tester measurements European Petroleum Conference, London, England, Oct. 25-28, 1984, SPE paper 12962.

Phelps et al The analysis of the invaded zone characteristics and their influence on wireline log and well-test interpretation SPE 59th Annual Technical Conference and Exhibition, Houston, Texas, U.S. A., Sep. 16-19, 1984, SPE paper 13287.

Proett et al Supercharge pressure compensation using a new wireline testing method and newly developed early time spherical flow model SPE Annual Technical Conference and Exhibiton, Denver, Colorado, U.S.A., Oct. 6-9, 1996, SPE paper 36524.

Proett et al Formation pressure testing in the dynamic drilling environment IADC/SPE Drilling Conference, Dallas, Texas, U.S.A., Mar. 2-4, 2004, SPE paper 87090.

Sarkar et al Adverse effects of poor mudcake quality: a supercharging and fluid sampling study SPE Reservoir Eval and Eng., vol. 3, No. 3, Jun. 2000 SPE paper.

Sherwood et al The filtration properties of compressible mud filtercakes Journal of Petroleum Science and Engineering, vol. 18, 1997, pp. 73-81.

* cited by examiner

METHOD AND SYSTEM FOR ESTIMATING THE AMOUNT OF SUPERCHARGING IN A FORMATION

This application claims priority from United Kingdom Patent Application No. 0423461.3, filed Oct. 22, 2004.

FIELD OF THE INVENTION

The present invention relates to a method and system for estimating the amount of supercharging in a formation.

BACKGROUND OF THE INVENTION

During drilling operations, overbalanced drilling fluid pressure and filtrate leak-off can cause pressure build-up in the local formation around the wellbore. This leak-off and pressure build-up, known as supercharging, is generally accompanied by filter cake deposition and growth at the sand face of the wellbore, and also changes within the formation due to mud filtrate invasion. The filter cake hydraulic conductivity changes with time, affecting the pressure drop across it, and the pressure behind it at the sand face. This makes it difficult to estimate the amount of supercharging and hence the far field formation pressure, even if the history of drilling fluid circulation and local wellbore pressure variation is known. A summary of the phenomenology of drilling fluid filtrate leak-off, during and after drilling, may be found in E. J. Fordham, D. F. Allen & H. K. J. Ladva "The Principle of a Critical Invasion Rate and its Implications for Log Interpretation" Society of Petroleum Engineers (SPE) paper 22539, (1991).

Conventional formation pressure measurements, made with formation testing tools which probe the formation from the wellbore, often read high compared to the actual reservoir pressure far from the borehole, due to the supercharging effect. This is a particular problem in relatively low permeability reservoirs (below approximately 1 mD/cp). Significant difficulties are related to (1) poor knowledge of filter cake and formation physical properties, (2) the long timescales over which wellbores are typically exposed to overbalanced pressure, and (3) practical time constraints, which often require pressure measurements to be carried out during a rather short time compared to the time of pressure build-up around a wellbore. Even with known transient pressure testing techniques, these difficulties make it problematical to sense the far field formation pressure at the boundary of the pressure build-up zone because of the slow pressure wave propagation inherent in low permeability formations.

Various schemes have been put forward for making supercharging corrections to wireline pressure measurements: see, for example, SPE paper 36524 ("Supercharge Pressure Compensation Using a New Wireline Testing Method and Newly Developed Early Time Spherical Flow Model"), EP-A-0897049, and SPE paper 64227 ("Adverse Effects of Poor Mudcake Quality: A Supercharging and Fluid Sampling Study"). SPE papers 12962 ("The Effect of Filtrate Invasion and Formation Wettability on Repeat Formation Tester Measurements") and 13287 ("The Analysis of the Invaded Zone Characteristics and Their Influence on Wireline Log and Well-Test Interpretation") discuss the role of two-phase flow effects, which are largely ignored in the later supercharging interpretation schemes.

U.S. Pat. No. 5,233,866 describes a tool and method for supercharging correction, in which filtrate leak-off rate is determined from the rate at which pressure decays in a closed volume of drilling fluid in contact with the filtercake and via that the formation.

U.S. Pat. No. 5,644,076 proposes a method for obtaining filtercake properties and filtrate leak-off rates from the rate of decay of pressure in a closed chamber of mud communicating with the formation through the filtercake. This information is then used in the determination of the supercharging pressure. U.S. Pat. No. 5,602,334 describes tool operation and interpretation methodologies for obtaining permeability and sandface pressure in low permeability formations.

SPE papers 84088 ("Formation Pressure Testing During Drilling: Challenges and Benefits") and 87091 ("Field Experience With a New Formation Pressure Testing-During-Drilling Tool") discuss Baker Hughes' TesTrak™ pressure measurement-while-drilling tool. The 87091 paper remarks on observations of supercharging in the field, but does not present a correction methodology. SPE paper 87090 ("Formation Pressure Testing In the Dynamic Drilling Environment") discusses Halliburton's GeoTap™ pressure measurement-while-drilling tool, discusses interpretation, and presents some simulations to show that significant supercharging is restricted to sub-milliDarcy formations. SPE paper 87092 ("An LWD Formation Pressure Test Tool (DFT) Refined the Otter Field Development Strategy") discusses PathFinder Energy Services' pressure measurement-while-drilling technique. This differs in design from other offerings, in that a dual packer system, rather than a small probe, is used to connect the tool to the formation. Little is said about supercharging or interpretation.

SPE paper 50128 ("New Techniques in Wireline Formation Testing in Tight Reservoirs") discusses the supercharging correction method of EP-A-0897049 ("Method and apparatus for determining formation pressure"), and comments that a) real measurements performed at a number of different wellbore pressures sometimes show evidence of cake compactability (because of variation of cake permeability with pressure), and b) "this would lead to significant errors in the calculation of the un-supercharged pressure". The document does not discuss how this error might be eliminated.

While conventional tools and techniques can often work well in relatively high permeability formations, where supercharging easily dissipates, there is still a need for a technique for estimating the amount of supercharging that can be successfully employed in relatively low permeability formations.

SUMMARY OF THE INVENTION

Accordingly, in general terms the present invention provides a method for estimating the amount of supercharging in a formation penetrated by a wellbore, in which pressure fluctuation measurements at a position in the formation accessible from the well bore and at an adjacent position in the wellbore are obtained, and a model is provided which relates variations in pressure with time at these positions to one or more adjustable parameters from which the amount of supercharging can be estimated. The or each parameter can then be adjusted to optimise the fit between the pressure variations predicted by the model and the measured pressure fluctuations, and the amount of supercharging can be estimated from the adjusted parameter(s).

More specifically, in a first aspect, the present invention provides a method for estimating the amount of supercharging in a formation penetrated by a wellbore, the method comprising the steps of:

obtaining measurements of pressure fluctuations at a position in the formation accessible from the well bore and at an adjacent position in the wellbore;

providing a formation flow model which relates variations in pressure with time at said positions to a plurality of adjustable parameters from which the amount of supercharging can be estimated, at least one of the parameters accounting for the influence on fluid flow of a wellbore filtercake layer and/or the influence on fluid flow of the formation;

adjusting the parameters to optimise the fit between the pressure variations predicted by the model and the measured pressure fluctuations; and estimating the amount of supercharging from the parameters thus-adjusted.

In some circumstances, one adjustable parameter can account for filtercake and formation properties. However, preferably, the model has respective adjustable parameters for filtercake and formation properties.

An example of an adjustable parameter which accounts for the influence on fluid flow of a wellbore filtercake layer is one which describes the degree of filtercake compactability. Another example of such a parameter is one which describes the hydraulic conductivity of the filtercake. The model may employ a respective parameter for the or each filtercake property, or alternatively, the properties may be combined in a single filtercake parameter. The degree of filtercake compaction and changes in the degree of compaction with time, in particular, can have significant effects on the flow of fluid from the wellbore to the formation.

Similarly, the formation pressure diffusivity, particularly in the near-wellbore region, and changes to the pressure diffusivity with time as filtrate penetrates the formation can have significant effects on the flow of fluid within the formation. The formation permeability can also significantly influence fluid flow. Thus the model may employ a respective parameter for the or each formation property, or alternatively, the properties may be combined in a single formation parameter.

None of filtercake compactability, filtercake hydraulic resistance and formation pressure diffusivity are easily measurable in the short time period typically available for making pressure measurements downhole. Also, with the exception of formation permeability and perhaps the formation pressure diffusivity, it is not generally possible to estimate reliably downhole values for such properties from retrieved samples analysed at the surface. Therefore, an advantage of the method according to this aspect of the invention is that the measured pressure fluctuations are effectively used to determine one or more adjustable parameters accounting for filtercake and/or formation properties, and these parameters in turn feed into the estimation of the amount of supercharging. Separate, time-consuming pre-tests to evaluate the relevant filtercake and formation properties may then not be necessary.

Preferably, the fit between the measured pressure fluctuations and the pressure variations predicted by the model is assessed in the time domain as opposed to the frequency domain. This is particularly advantageous if the model is non-linear, as a frequency domain assessment would tend to be less accurate or might require further measurement data. Also the loss of information which occurs when data is converted between the time and the frequency domain and interpretation is performed using a single frequency component only can be avoided.

Indeed, in a second aspect, the present invention provides a method for estimating the amount of supercharging in a formation penetrated by a wellbore, the method comprising the steps of:

obtaining measurements of pressure fluctuations at a position in the formation accessible from the well bore and at an adjacent position in the wellbore;

providing a formation flow model which relates variations in pressure with time at said adjacent positions to one or more adjustable parameters from which the amount of supercharging can be estimated; and adjusting the or each parameter to optimise the fit between the pressure variations predicted by the model and the measured pressure fluctuations, the fit between the measured pressure fluctuations and the pressure difference variations predicted by the model being assessed in the time domain; and estimating the amount of supercharging from the parameter or parameters thus-adjusted.

The following optional features pertain to the method described in general terms above and in both of the above aspects.

The pressure fluctuations may take the form of a series of pressures pulsations and associated transients. Preferably, the pressure fluctuations are measured over a time interval of at most 30 minutes, and more preferably at most 20 or 10 minutes. In general, and particularly during measurement-while-drilling, the total measurement period should be minimised to reduce rig-time costs and reduce the risk of tool sticking.

Conveniently, the measurement position in the formation is at the sandface of the wellbore. The pressure measured in the wellbore is typically the wellbore fluid pressure. A layer of filtercake will usually be interposed between the measurement positions.

Preferably, the model is a forward model which accounts for the drilling history of the wellbore. This can be advantageous because the wellbore will often have been exposed to overbalanced pressure for a long period before the pressure measurements are made. In low permeability formations, this long period of exposure will have a significant effect on the amount of supercharging.

The method may be performed on stored measurement data or on real-time data with processing downhole or at surface.

The obtaining step may include providing a measuring tool in the wellbore to measure the pressure fluctuations. In this case, the measuring tool may be attached to a drill string or attached to a wireline.

The method may further comprise the step of inducing the pressure fluctuations, which may take the form of a series of pressure steps (typically pressure drops, staircase fashion) and associated transients. This is generally preferred to relying on suitable pressure fluctuations being produced by chance or by unrelated drilling operations.

The model may be provided on a downhole computing system, e.g. carried by a measuring tool for measuring the pressure fluctuations, and the method may then further comprise the step of transmitting a signal representing the estimated amount of supercharging from the computing system to the surface.

Alternatively, the model may be provided on a surface computing system, and the method then further comprise the step of transmitting a signal representing the measured pressure fluctuations from the measuring tool to the computing system.

The invention also provides a computer system for performing the method described in general terms above and in both of the above aspects.

For example, the computer system may have an input device for receiving pressure fluctuation measurements obtained at a position in the formation accessible from the well bore and at an adjacent position in the wellbore, and a memory device carrying a model which relates variations in pressure with time at these positions to an adjustable parameter accounting for the amount of supercharging. The system may further have a processor for optimally fitting the pressure variations predicted by the model to the measured pressure fluctuations by adjustment of this parameter in the model, and estimating the amount of supercharging from the adjusted parameter.

In one aspect, the present invention provides a computer system for estimating the amount of supercharging in a formation penetrated by a wellbore comprising:

an input device for receiving pressure fluctuation measurements obtained at a position in the formation accessible from the well bore and at an adjacent position in the wellbore;

a memory device carrying a formation flow model which relates variations in pressure with time at these positions to a plurality of adjustable parameters from which the amount of supercharging can be estimated, at least one of the parameters accounting for the influence on fluid flow of a wellbore filtercake layer and/or the influence on fluid flow of the formation; and a processor for optimally fitting the pressure variations predicted by the model to the measured pressure fluctuations by adjustment of said parameters, and estimating the amount of supercharging from the adjusted parameters.

In a further aspect, the present invention provides a computer system for estimating the amount of supercharging in a formation penetrated by a wellbore comprising:

an input device for receiving pressure fluctuation measurements obtained at a position in the formation accessible from the well bore and at an adjacent position in the wellbore;

a memory device carrying a formation flow model which relates variations in pressure with time at these positions to a plurality of adjustable parameters from which the amount of supercharging can be estimated; and a processor for optimally fitting the pressure variations predicted by the model to the measured pressure fluctuations by adjustment of said parameters, and estimating the amount of supercharging from the adjusted parameters, the fit between the measured pressure fluctuations and the pressure difference variations predicted by the model being assessed in the time domain.

Optional features of the method of the present invention also apply to the computer system described in general terms above and in both of the above aspects.

In some embodiments, the computer system may be carried by a downhole measuring tool for measuring the pressure fluctuations. In other embodiments, the computer system may be a surface system which, in use, communicates with a downhole measuring tool. Either way, the measuring tool may be a wireline tool or a measuring-while-drilling tool.

BRIEF DESCRIPTION OF THE DRAWINGS

Embodiments of the invention will now be described by way of example with reference to the accompanying drawings in which.

DETAILED DESCRIPTION

Figure 1:
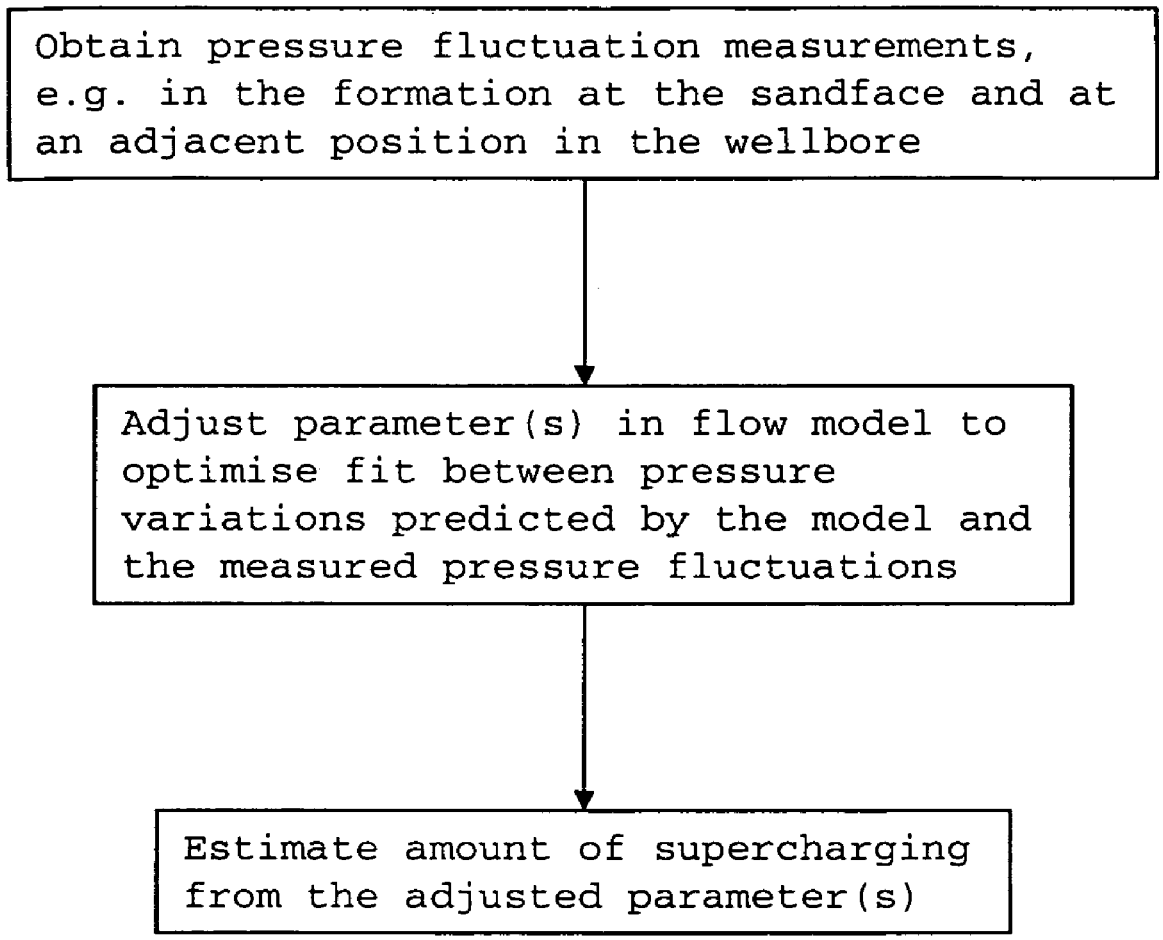
FIG. 1 shows a flow chart illustrating stages in the method for estimating the amount of supercharging of the present invention.

FIG. 1 is a flow chart showing stages in the method for estimating the amount of supercharging of the present invention.

Equipment

Figure 2:
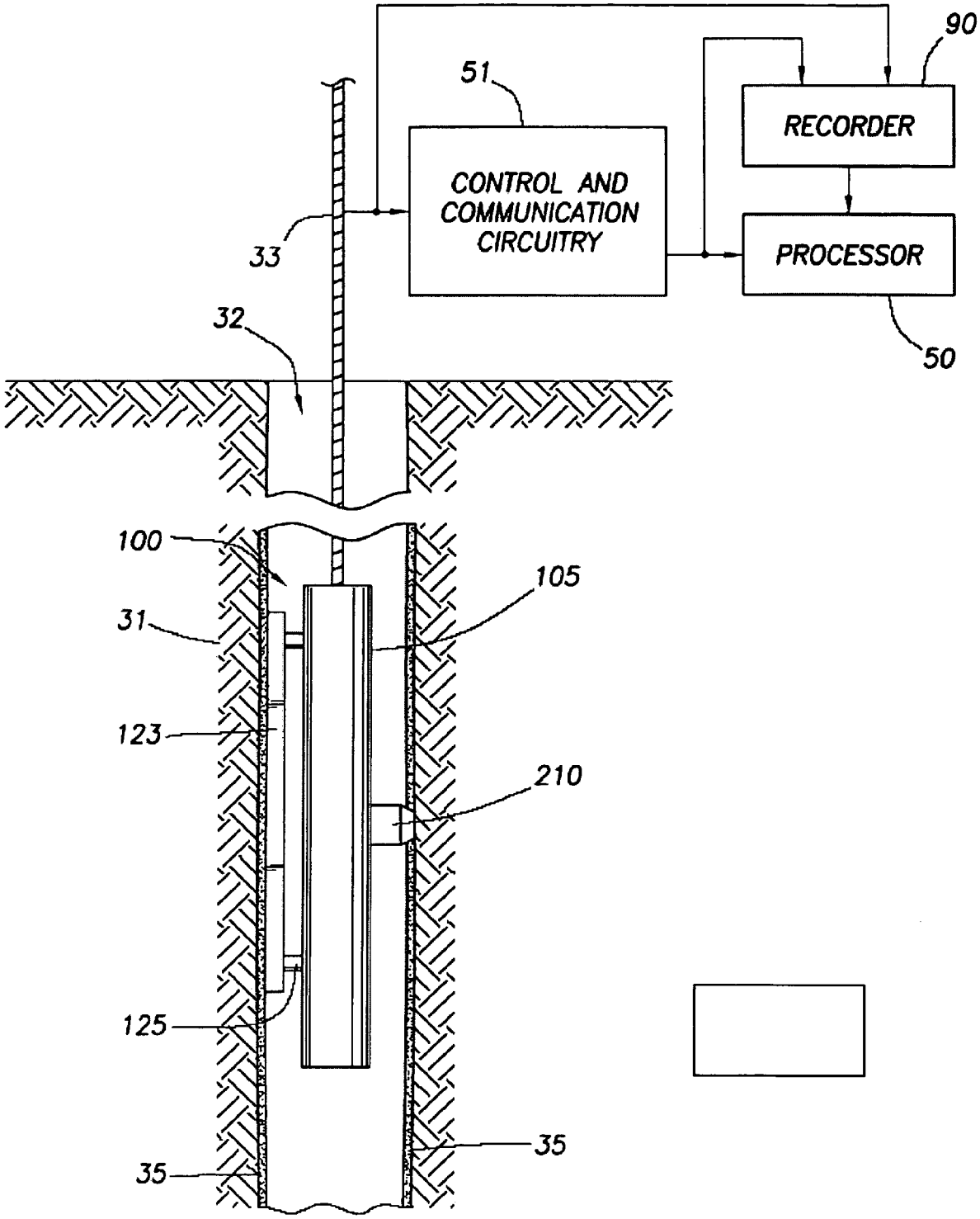
FIG. 2 shows schematically a wireline type of equipment that can be used to obtain pressure measurements.

FIG. 2 illustrates a wireline type of equipment that can be used to obtain the pressure measurements used in the present invention. Borehole 32 has been drilled in formation 31, in known manner, with drilling equipment, and using drilling fluid or mud that has resulted in a filtercake represented at 35. For each depth region of interest, the time since cessation of drilling is recorded, in known manner, for example by using a clock or other timing means, processor, and/or recorder. A formation tester apparatus or device 100 is suspended in the borehole 32 on an armoured multiconductor cable 33, the length of which substantially determines the depth of the device 100. Known depth gauge apparatus (not shown) is provided to measure cable displacement over a sheave wheel (not shown) and thus the depth of logging device 100 in the borehole 32. Circuitry 51, shown at the surface although portions thereof may typically be downhole, represents control and communication circuitry for logging device 100. Also shown at the surface are processor 50 and recorder 90. These may all generally be of known type, and include appropriate clock or other timing means.

The logging device 100 has an elongated body 105, which encloses the downhole portion of the device controls, chambers, measurement means, etc. Suitable such devices are described, for example, in U.S. Pat. Nos. 3,934,468, and 4,860,581. One or more arms 123 can be mounted on pistons 125 which extend, e.g. under control from the surface, to set the tool. The logging device includes one or more probe modules that include a probe assembly 210 having a probe that is outwardly displaced into contact with the borehole wall, piercing the filtercake 35 and communicating with the formation. The equipment and methods for taking individual hydrostatic pressure measurements and/or probe pressure measurements are well known in the art, and the logging device 100 is provided with these known capabilities.

Figure 3:
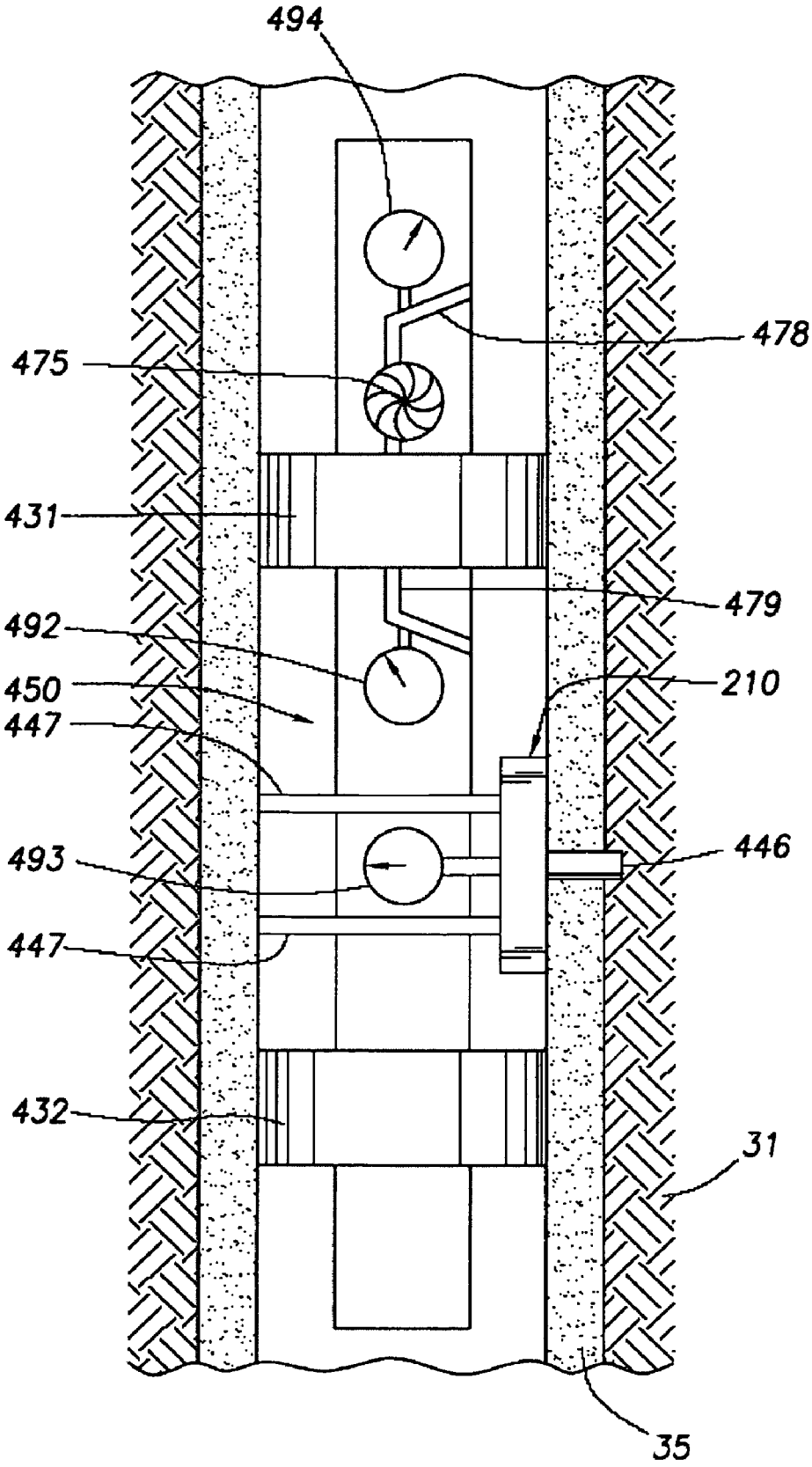
FIG. 3 shows schematically a portion of the well logging device of the wireline type of equipment of FIG. 2.

FIG. 3 shows a portion of the well logging device 100. The device (see EP-A-0897049) can vary locally the borehole pressure at the region where the device is positioned. The device includes inflatable packers 431 and 432, which can be of a type that is known in the art, together with suitable activation means (not shown). When inflated, the packers 431 and 432 isolate the region 450 of the borehole, and the probe 446, shown with its own setting pistons 447, operates from within the isolated region and communicates with the formation adjacent the filtercake. A pump-out module 475 which can be of a known type (see, for example, U.S. Pat. No. 4,860,581), includes a pump and a valve, and the pump-out module 475 communicates via a line 478 with the borehole outside the isolated region 450, and via a line 479, through the packer 431, with the isolated region 450 of the borehole. The packers 431, 432 and the pump-out module 475 can be controlled from the surface. The borehole pressure in the isolated region is measured by pressure gauge 492, and the probe pressure is measured by the pressure gauge 493. The borehole pressure outside the isolated region can be measured by pressure gauge 494. Device 100 can be provided with multiple pumping and/or suction ports for use in the testing phase. The pressure within the isolated region 450 is varied by pumping appropriate volumes of fluid in and out, using the pump-out module 475. Wellbore pressure variations can also be induced by pumping fluid in and out of the otherwise sealed wellbore at surface. In this case, packers 431 & 432 and pump-out module 475 are not needed.

Figure 4:
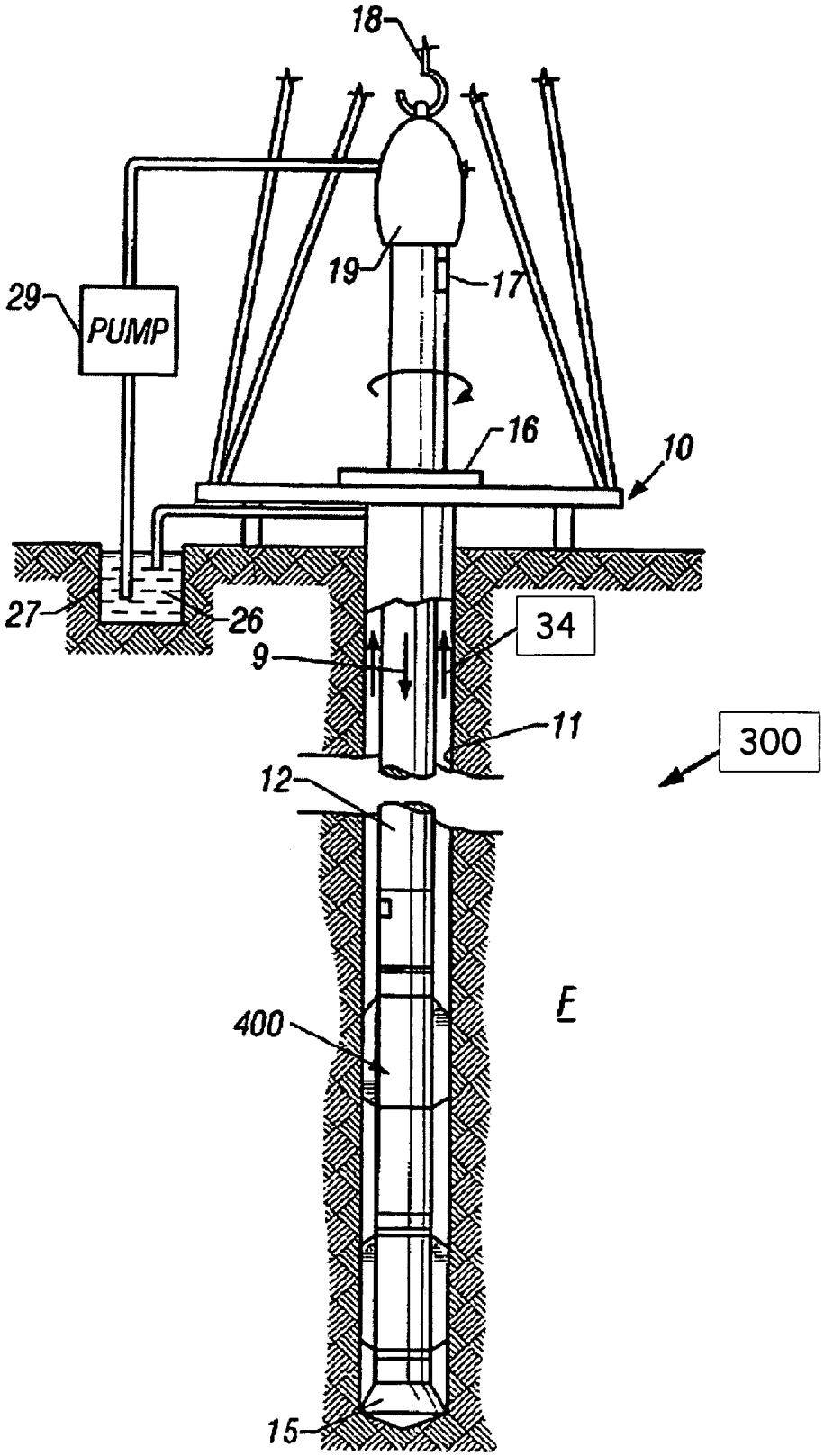
FIG. 4 shows schematically a drilling rig and MWD tool.

The present invention can also be practiced using measurement-while-drilling ("MWD") equipment (which includes measuring while tripping). FIG. 4 illustrates a conventional drilling rig and drill string. Land-based platform and derrick assembly 10 are positioned over wellbore 11 penetrating subsurface formation F. Drill string 12 is suspended within wellbore 11 and includes drill bit 15 at its lower end. Drill string 12 is rotated by rotary table 16, and energized by a motor or engine or other mechanical means (not shown), which engages kelly 17 at the upper end of the drill string. Drill string 12 is suspended from hook 18, attached to a traveling block (not shown), through kelly 17 and rotary swivel 19 which permits rotation of the drill string relative to the hook.

Drilling fluid or mud 26 is stored in pit 27 formed at the well site. Pump 29 delivers drilling fluid 26 to the interior of drill string 12 via a port in swivel 19, inducing the drilling fluid to flow downwardly through drill string 12 as indicated by directional arrow 9. The drilling fluid exits drill string 12 via ports in drill bit 15, and then circulates upwardly through the region between the outside of the drillstring and the wall of the wellbore, called the annulus, as indicated by direction arrows 34. In this manner, the drilling fluid lubricates drill bit 15 and carries formation cuttings up to the surface as it is returned to pit 27 for recirculation.

Drillstring 12 further includes a bottom hole assembly 300 near the drill bit 15 (for example, within several drill collar lengths from the drill bit). The bottom hole assembly 300 is equipped with a MWD evaluation tool 400 forming part of the drill string 12. Further details of the tool can be found in US Patent Application 20030098156. The MWD evaluation tool 400 includes probe(s) and measurement capabilities broadly similar to the device described in conjunction with FIG. 3. A significant difference is that use of packers analogous to 431 and 432, and the pump-out system 475, are not always necessary, because wellbore pressure fluctuations can be generated by other means e.g. variation of the drilling fluid circulation rate by adjustment of the surface pump 29. Hence, items 431, 432 and 475 may be absent. If they are present, then a flow path for by-pass of the circulating drilling fluid will be provided within the tool.

Modelling (1) Formation Flow Model

It is well known in the field of pressure transient well testing that for single phase, slightly compressible, radial flow in a homogeneous medium, the flow rate of fluid into the formation, q(t), and the pressure within the formation at the sandface, $p_{sf}(t)$, are linked by a convolution integral $$p_{sf}(t) = p_\infty + \int_{-t_0}^{t} R(t-t')q(t')\,dt', \tag{1}$$

where $p_\infty$ denotes the undisturbed far field formation pressure, and the formation was first exposed to flow at time $t=-t_0$ (i.e. the wellbore was created at the formation of interest at time $t=-t_0$). The impulse response R is given by $$R(t) = \frac{\mu r_w}{k}\frac{4\kappa}{\pi}\int_0^\infty \frac{e^{-\kappa t u^2}}{u(J_1^2(u)+Y_1^2(u))}\,du = \frac{\mu r_w}{k}\kappa R_D(\kappa t), \tag{2}$$

where $r_w$ is the wellbore radius, k is the formation permeability, $\phi$ its porosity, $c_t$ the total compressibility of fluid and matrix, $\mu$ the pore fluid viscosity, and for later convenience we set $\kappa=k/(\phi\mu c_t r_w^2)$. $J_1$ and $Y_1$ are Bessel functions (see e.g. M. Abramowitz and I. A. Stegun, "Handbook of Mathematical Functions", (1972), chapter 9). The sandface pressure response to a constant unit rate leak off, H(t), is obtained by integrating (2) to obtain $$H(t) = \frac{\mu r_w}{k}\frac{4}{\pi}\int_0^\infty \frac{(1-e^{-\kappa t u^2})}{u^3(J_1^2(u)+Y_1^2(u))}\,du = \frac{\mu r_w}{k}H_D(\kappa t), \tag{3}$$

(see H. S. Carslaw and J. C. Jaeger, "Conduction of Heat in Solids" 2nd edition, Clarendon Press Oxford, (1959), chapter 13). This expression is central below in the numerical evaluation of (1). The functions $R_D$ and $H_D$ can easily be precomputed, and stored in look-up tables. Since only one parameter, $\kappa t$, appears, fast computation of the convolution (1), or expressions derived from it, is possible.

Suppose now leak-off conditions start to change significantly at time t=0, because for example the wellbore pressure is deliberately varied from that time on. Also, let us introduce a quantity $q_{history}(t')$ which is equal to q(t') for $-t_0 \leqq t' \leqq 0$. Its values for $0 \leqq t \leqq 't$ will be defined below. A trivial rearrangement of (1) then leads to $$p_{sf}(t) = p_\infty + \int_{-t_0}^{t} R(t-t')q_{history}(t')\,dt' + \int_0^t R(t-t')(q(t')-q_{history}(t'))\,dt', \tag{4}$$

which we can interpret as saying that the sandface pressure is the sum of the effects of past history (the first two terms) and recent events (the final term).

Figure 5:
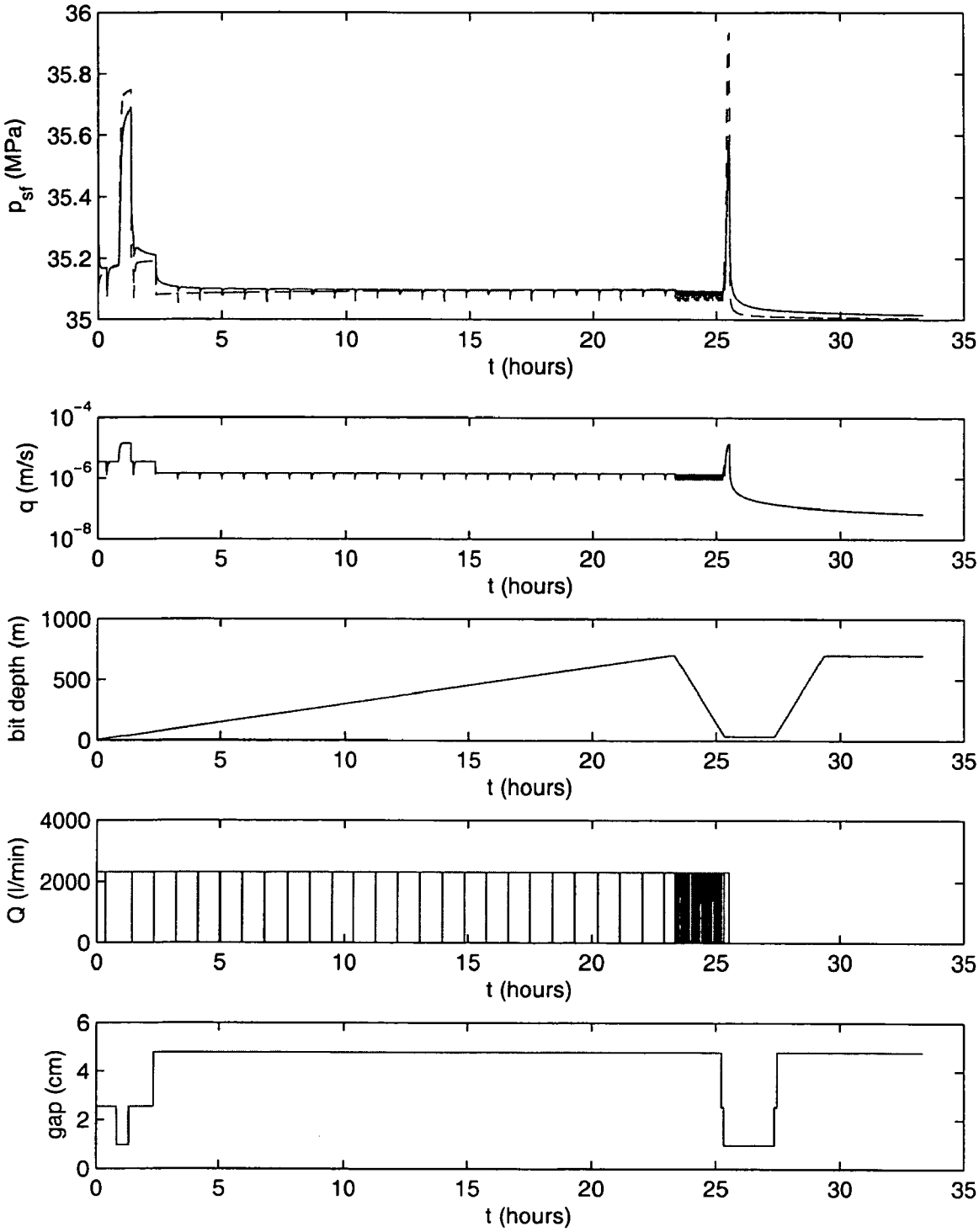
FIG. 5 shows results from a simulation of filtrate leak-off rate and sandface pressure over a 34 hour period of drilling.

A reasonable approximation to the first integral term in (4), which we denote as $p_{history}(t)$, can be had in many while-drilling wellbore filtration contexts by assuming that the leak-off rate has taken a value equal to its current value at all times since the hole was opened to drilling. FIG. 5 shows results from a numerical simulation of filtrate loss and formation pressure while drilling to support this assertion. The solid line in the upper track of the Figure is the "exact" computed sandface pressure, while the broken line shows the approximation $$p_{lower}(t) = p_\infty + q(t)\frac{\mu r_w}{k} H_D\left(\frac{kt}{\phi\mu c_t r_w^2}\right). \quad (5)$$

The exact and approximate results can be seen to be close numerically, except just after 25 hours. The remaining tracks in the Figure show the computed filtrate leak-off rate, the depth of the drill bit relative to the formation into which leak-off is occurring, the rate of drilling fluid circulation, and the gap between drill string and sandface at the formation. The mud, formation and hydraulics parameters are chosen so as to reproduce realistic drilling hydraulics conditions. The formation permeability was 10 mD. As further justification for the approximation, note that using the constant leak-off rate solution for the sandface pressure (3) and (20), it can be shown that the time $t_{forget}$ required after a step change in leak-off rate of size $\Delta q$ for the sandface pressure to be within $\Delta p$ of the value it would have had had the leak off rate taken the post-change rate at all previous times is given approximately by $t_{forget}=t_0/(\exp(2k\Delta p/\mu r_w\Delta q)-1)$. If the time after drilling $t_0$ is one hour, the formation permeability k is 10 mD, the fluid viscosity $\mu$ is 1 mPa·s and the wellbore radius $r_w$ is 0.1 m, then for $\Delta p=10^4$ Pa and $\Delta q=10^{-6}$ m/s, $t_{forget}$ is around 10 minutes. For these parameter values at least, pre-change conditions are largely forgotten after 10 minutes. "Forgetting times" are longer in lower permeabilities, or for larger changes in leak-off rate or more stringent accuracy requirements (i.e. smaller $\Delta p$ values). For measurements made several "forgetting times" after the last major change in leak-off conditions, it is reasonable to compute the sandface pressure on the basis of the current leak-off rate.

For measurements made post-drilling e.g. by a wireline tool, a different approximation should be made, which takes account of the declining filtrate leak-off rates due to continual cake growth. This is outlined in the Model Enhancements Appendix. It is also feasible to improve the approximation of the fluid loss rate while drilling, if the time histories of drilling fluid circulation rate and bit position are available. This is also outlined in the Model Enhancements Appendix.

Specifically, in while-drilling contexts we here make the approximation $$q_{history}(t')=q(0) \text{ for } -t_0 \leq t' \leq t. \quad (6)$$

It then follows that for t>0

$$\begin{aligned} p_{history}(t) &\approx p_\infty + \int_{-t_0}^{t} R(t-t')q(0)\,dt' \\ &= p_\infty + q(0)H(t+t_0), \end{aligned} \quad (7)$$

and also $$p_{sf}(0) \approx p_\infty + q(0)H(t_0). \quad (8)$$

However, if desired, and at the cost of an extra adjustable parameter to be determined and thus a need for an additional independent input measurement, an additional term proportional to $R(t+t_0)$ may be added to the above expressions, to allow the cumulative fluid loss also to be matched. Treatment of multiphase flow within the formation is briefly discussed in the Model Enhancements Appendix.

(2) Wellbore Filtercake Flow Model

We consider next the modeling of fluid loss through the cake. It will be assumed that the leak-off rate through a filtercake is related to the pressure drop across it by $$q = \frac{S^2(\Delta p)}{2V^*}, \quad (9)$$

where V* is the volume of filtrate per unit area that would have been lost had the present cake been built under constant conditions of differential pressure and hydraulic shear stress, S is the desorptivity, and $\Delta p$ is the difference between the current wellbore and sandface pressures, $p_{well}(t)$ and $p_{sf}(t)$ respectively. V* is proportional to the mass of solids in the cake, M(t).

The basic idea behind the approximation (9) is that the filtercake adjusts instantaneously to the applied filtration pressure, and that its hydraulic resistance is the same as that of a static filtercake containing the same mass of solids at the same differential pressure. Equation (9) can be derived as follows. It is well known that the cumulative fluid loss volume per unit area in static filtration of drilling mud on a substrate of negligible resistance, varies with time as $V(t)=S(\Delta p)t^{1/2}$ (see E. J. Fordham, D. F. Allen & H. K. J. Ladva "The Principle of a Critical Invasion Rate and its Implications for Log Interpretation" SPE paper 22539, (1991)). The associated fluid loss rate is $q(t)=S(\Delta p)t^{-1/2}/2$. Combining these two expressions, to eliminate $t^{1/2}$ in favour of V(t), we obtain an expression like (9), with V* replaced by V. This expression is a trivial identity for static filtration data obtained under conditions of constant filtration pressure. The central modelling assumption here is that (9) is true for the instantaneous values of the fluid loss rate, the fluid loss volume corresponding to the actual mass of solids in the cake, and filtration pressure, at every instant in a wellbore filtration process be it in quasi-static filtration with cake growth, in equilibrium dynamic filtration during which time no matter is being added to the cake, or during instants when the wellbore pressure or mud circulation rate is changing. The physical interpretation is:

The cake is assumed to adjust instantaneously to any change in filtration-controlling parameters, and The state of the cake, and the fluid loss through it is controlled by the mass of solids in the cake and the state of compaction of those solids (which in turn is controlled by the pressure drop across the cake).

Further insight can be obtained from consideration of the incompactable case. There, it is well known that $S \propto \sqrt{\Delta p}$, and the cake thickness T is simply proportional to M. As a result, equation (9) becomes $q \propto \Delta p/T$, which is the expected Darcy flow relation.

Since the model assumes instantaneous adjustment of the filtercake to changing conditions, we must interpret it as being useful for predictions of the long-time features of the fluid loss and cake growth processes, and as being invalid should features on the time scales comparable with those for internal re-adjustments of the filtercake be of interest. Extensions of the model and methodology to take account of this are discussed in the Model Enhancements Appendix. Furthermore, equation (9) does not keep track of the small amounts of filtrate squeezed from the cake, or sucked into it, when it compacts and expands as the filtration pressure is changed; as a result, a small filtrate mass balance error is incurred.

If we concern ourselves only with processes involving an already developed filtercake, and happening over time scales that are short compared to the time scale over which that cake grew, then it is permissible to treat V* as a constant. It has been found that over a limited range a power law for the pressure dependence of the desorptivity fits most data, whence we set $$S(\Delta p)=\begin{cases} S_{ref}(\Delta p_{ref})\left(\frac{\Delta p}{\Delta p_{ref}}\right)^{n} & \text{if } \Delta p \geq \Delta p_{max}, \\ S_{ref}(\Delta p_{ref})\left(\frac{\Delta p_{max}}{\Delta p_{ref}}\right)^{n}\left(\frac{\Delta p}{\Delta p_{max}}\right)^{n'} & \text{otherwise.} \end{cases} \quad (10)$$

If the cake is always subjected to differential pressures that are less than the maximum it has already experienced, then only the de-compaction branch (the lower expression on the right hand side of (10)) is relevant, and we may write $$S(\Delta p)=\alpha\Delta p^{n'} \quad (11)$$

and then from (9), $$q(t)=\frac{\alpha^2(\Delta p(t))^{2n'}}{2V^*}, \quad (12)$$

where $$\alpha=S_{ref}(\Delta p_{ref})\left(\frac{\Delta p_{max}}{\Delta p_{ref}}\right)^{n}\left(\frac{1}{\Delta p_{max}}\right)^{n'}.$$

(3) Coupling the Models

The cake and formation models are coupled, by combining (4) and (12), using (7), to obtain $$p_{sf}(t)\approx p_\infty+\frac{\alpha^2(p_{well}(0)-p_{sf}(0))^{2n'}}{2V^*}H(t+t_0)+\int_0^t R(t-t')\frac{\alpha^2\left((p_{well}(t')-p_{sf}(t'))^{2n'}-(p_{well}(0)-p_{sf}(0))^{2n'}\right)}{2V^*}dt'. \quad (13)$$

While it is possible to use this expression as the basis of a parameter-fitting interpretation, numerical experiments suggest that it is better to work with the difference, $p_{sf}(t)-p_{sf}(0)$, rather than with $p_{sf}(t)$ itself. This reduces by one the number of unknown parameters that must be estimated (indeed, equation (16) below shows that within the present formulation $p_\infty$ is not independent of the other parameters). Using (8), we obtain from (13)

$$p_{sf}(t)-p_{sf}(0)\approx\frac{\alpha^2(p_{well}(0)-p_{sf}(0))^{2n'}}{2V^*}(H(t+t_0)-H(t_0))+\int_0^t R(t-t')\frac{\alpha^2\left((p_{well}(t')-p_{sf}(t'))^{2n'}-(p_{well}(0)-p_{sf}(0))^{2n'}\right)}{2V^*}dt', \quad (14)$$

which on setting $A=\alpha^2\mu r_w/(2kV^*)$ and $m=2n'$, and using (2) and (3), may be re-written as $$p_{sf}(t)-p_{sf}(0)=A(p_{well}(0)-p_{sf}(0))^m(H_D(\kappa(t+t_0))-H_D(\kappa t_0))+A\kappa\int_0^t R_D(\kappa(t-t'))((p_{well}(t')-p_{sf}(t'))^m-(p_{well}(0)-p_{sf}(0))^m)dt'. \quad (15)$$

Equation (15) is a time-domain model linking wellbore and sandface pressures, for while-drilling filtration with a compactable filter cake. For wireline situations, however, some aspects of the model should be altered. Possible alterations are discussed in the Model Enhancements Appendix. Equation (15) has three adjustable parameters $\{A,\kappa,m\}$, A accounting for filtercake permeability relative to that of the formation, $\kappa$ accounting for the pressure diffusivity in the formation, and m being a filtercake compactability factor. When these parameters have been determined, the formation far-field pressure, and hence the amount of supercharge, follows from (8) as $$p_\infty=p_{sf}(0)-A(p_{well}(0)-p_{sf}(0))^m H_D(\kappa t_0). \quad (16)$$

An advantage of the time domain approach, as opposed to a frequency domain approach, is that it is better able to handle non-linear models. Also loss of information which occurs when data is converted between the time and the frequency domain and a single frequency interpretation is made can be avoided.

(4) Optimising the Model

Given measurements of the wellbore and sandface pressures at a set of times $\{t_i\}$, the three unknown independent parameters in (15), $\{A,\kappa,m\}$, may be determined using a standard optimization routine to minimize the sum of squared residuals $$\sum_i \varepsilon^2(t_i)/\sigma_i^2, \quad (17)$$

$$\text{where } \varepsilon(t)=p_{sf}(t)-p_{sf}(0)-A\left[\Delta p(0)^m(H_D(\kappa(t+t_0))-H_D(\kappa t_0))+\kappa\int_0^t R_D(\kappa(t-t'))(\Delta p(t')^m-\Delta p(0)^m)dt'\right],$$

the $\sigma_i$ are estimates of the magnitude of measurement errors, and $\Delta p(t)=p_{well}(t)-p_{sf}(t)$. Naturally, if the value of m and/or $\kappa$ are known (e.g. in the case of incompactable filtercake, m=1), then these parameters can be excluded from the minimization procedure in order to speed up the process. Prior knowledge of likely parameter values and ranges may be included, by adding a suitable (logarithm of prior distribution) term to the sum of squared residuals.

In a practical application, the sandface and wellbore pressures will generally be measured at a discrete set of times. It is then necessary to numerically evaluate the convolution integral in (17), given a table of values of $\Delta p(t)$ defined at a set of times $\{t_i\}$, with $t_1=0$. Using the approach outlined in the Mathematical Appendix, we obtain $$\varepsilon(t_j)=p_{sf}(t_j)-p_{sf}(0)-A\left[\begin{array}{c}\Delta p(0)^m(H_D(\kappa(t_j+t_0))-H_D(\kappa t_0))+\\ \frac{(\Delta p(t_2)^m-\Delta p(t_1)^m)}{2}H_D(\kappa(t_j-t_1))+\\ \sum_{i=2}^{j-1}\frac{\Delta p(t_{i+1})^m-\Delta p(t_{i-1})^m}{2}H_D(\kappa(t_j-t_i))\end{array}\right], \quad (18)$$

which can be used to perform the evaluation.

Wellbore Pressure Variation Sequence

In order to be able to determine all of the unknown parameters in (15) or (18), the system must be subjected to a sufficiently "rich" stimulus. For example, a stimulus using several different mean wellbore pressures may be used.

However, a number of operational constraints must be respected. For example, while drilling, pressures within the wellbore are mainly changed by reducing the pump rate (or by bypassing some fraction of the injected mud flow at surface). Also, in order to stay on a single branch of the hysteretic desorptivity, the wellbore pressure (strictly, the differential pressure across the filtercake) must either always be increasing, or always be less than its previous maximum value. The frequency of the pulsations should be chosen so that the total sequence time is not too long (rig-time costs and tool sticking considerations may limit the total sequence time to less than 10 minutes). The frequency content (or time scales) should be chosen so that the depth of investigation of the pressure transient is not so great that the assumption of homogeneous radial flow within the formation is rendered invalid.

Figure 6:
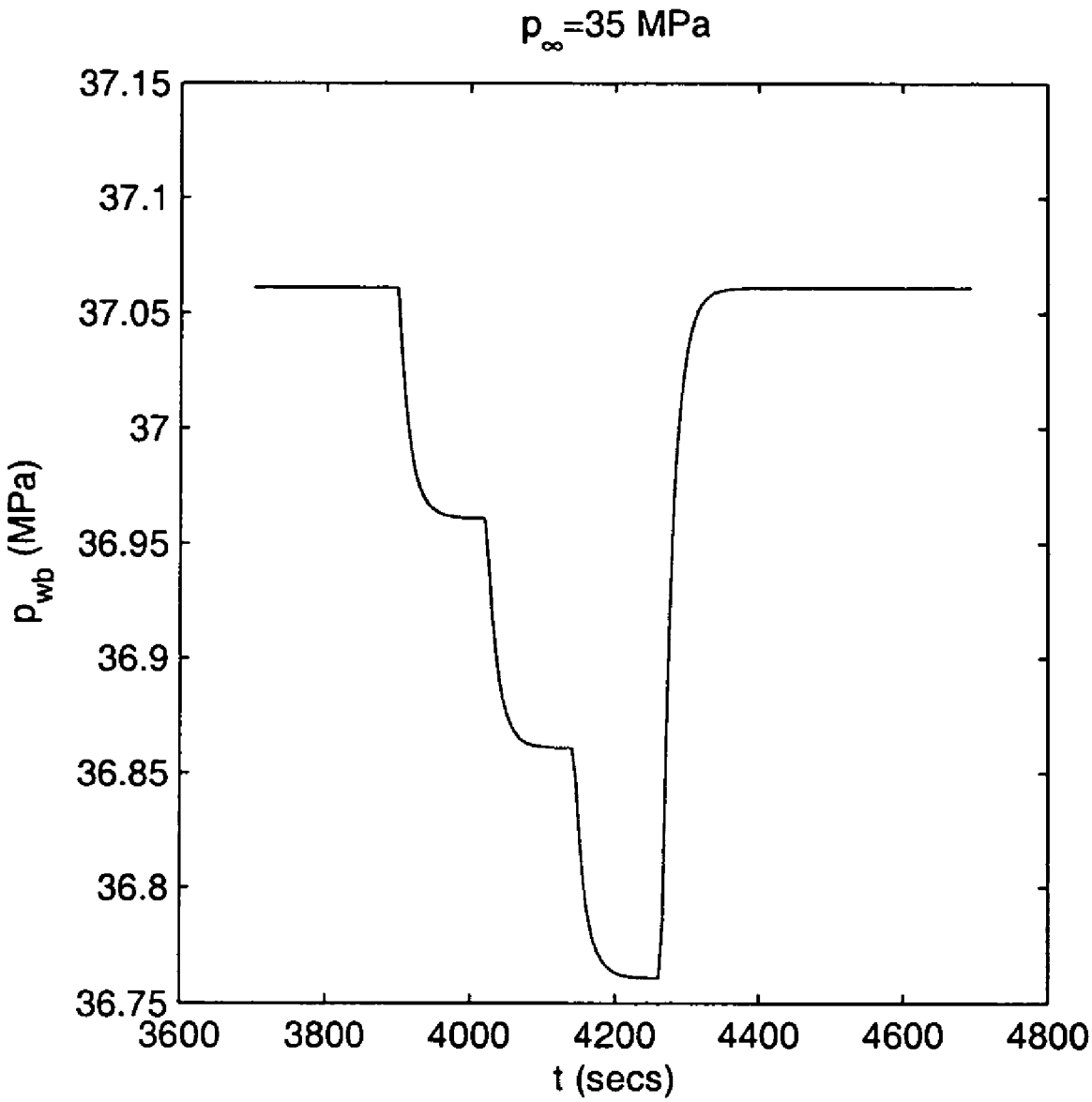
FIG. 6 shows a pressure variation sequence with stepwise decreases in wellbore pressure.

Taken together, the above considerations suggest a wellbore pressure variation sequence in which the pressure is varied between a series of mean values all below the initial mean value. Such a sequence is sketched in FIG. 6, which shows stepwise decreases in wellbore pressure. In each step the wellbore pressure reduces by one bar with an exponential decay of time constant 15 seconds. The total duration of the sequence is about 10 minutes.

It should be noted, however, that a suitable pressure variation sequence may occur naturally during drilling operations, i.e. without the sequence having to be specially induced.

EXAMPLE

Figure 7:
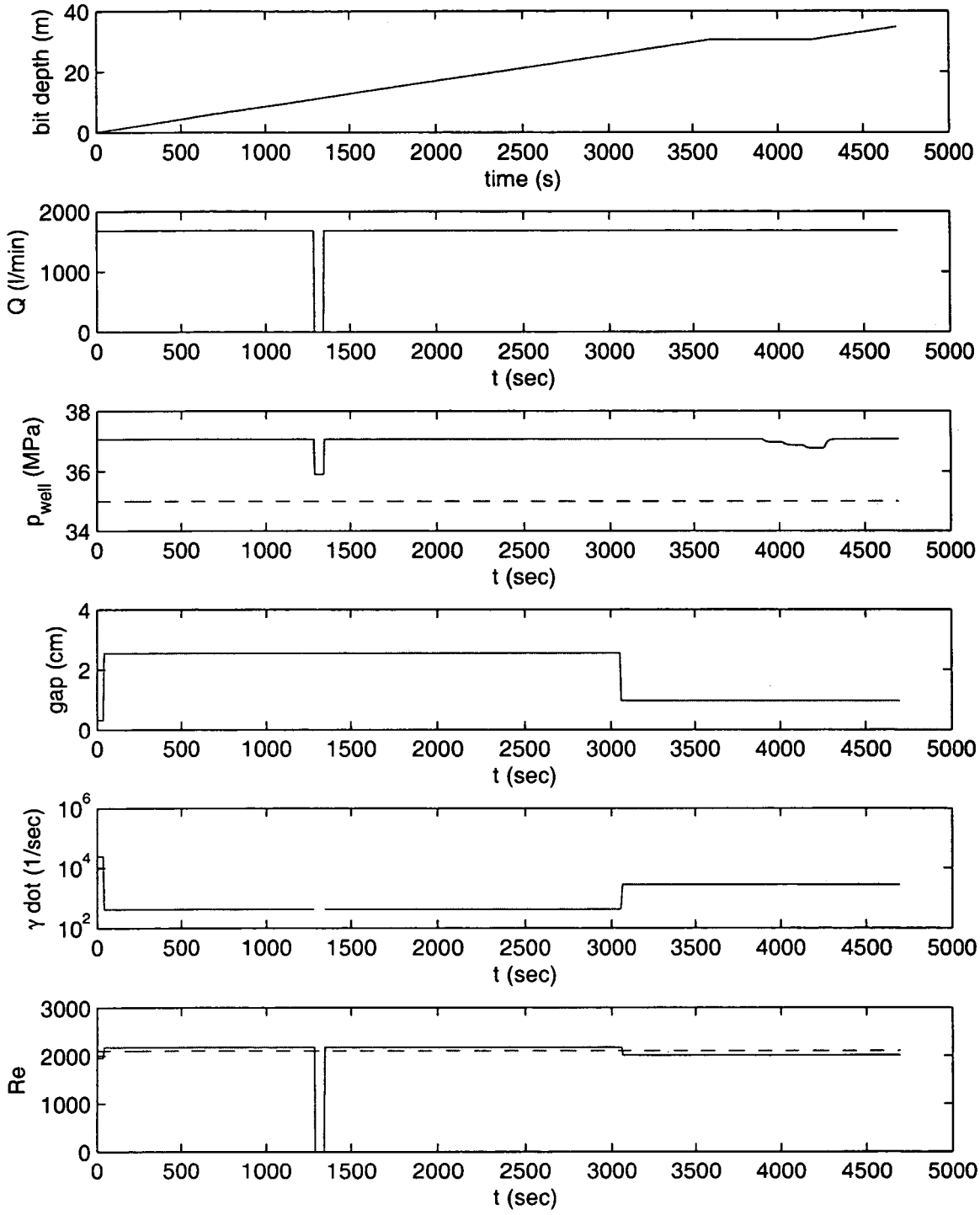
FIG. 7 show graphs summarising simulated wellbore conditions prior to and during a measurement sequence.
Figure 8:
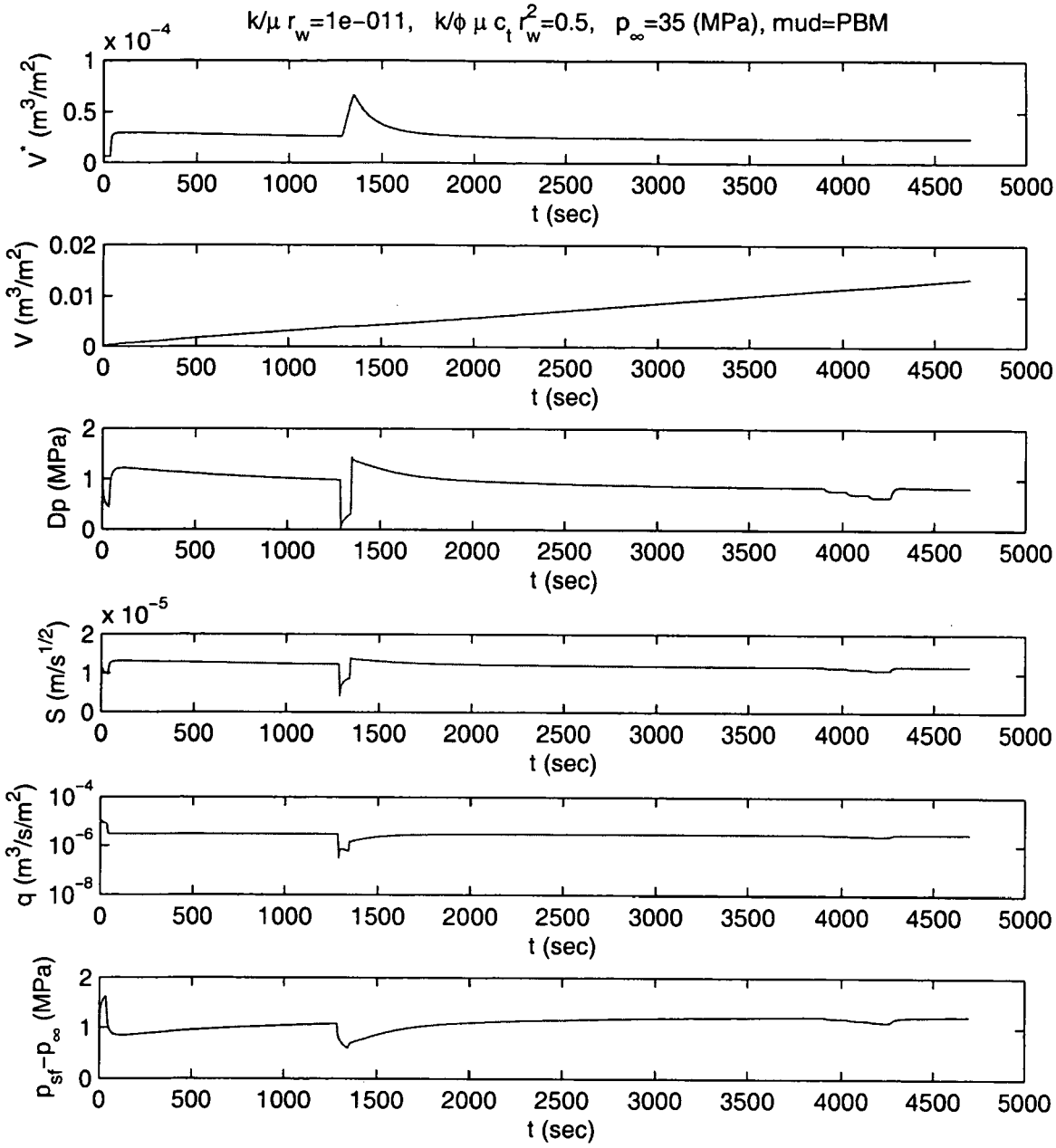
FIG. 8 show graphs summarising the results from a forward model of filtration using the wellbore conditions of FIG. 7.
Figure 9:
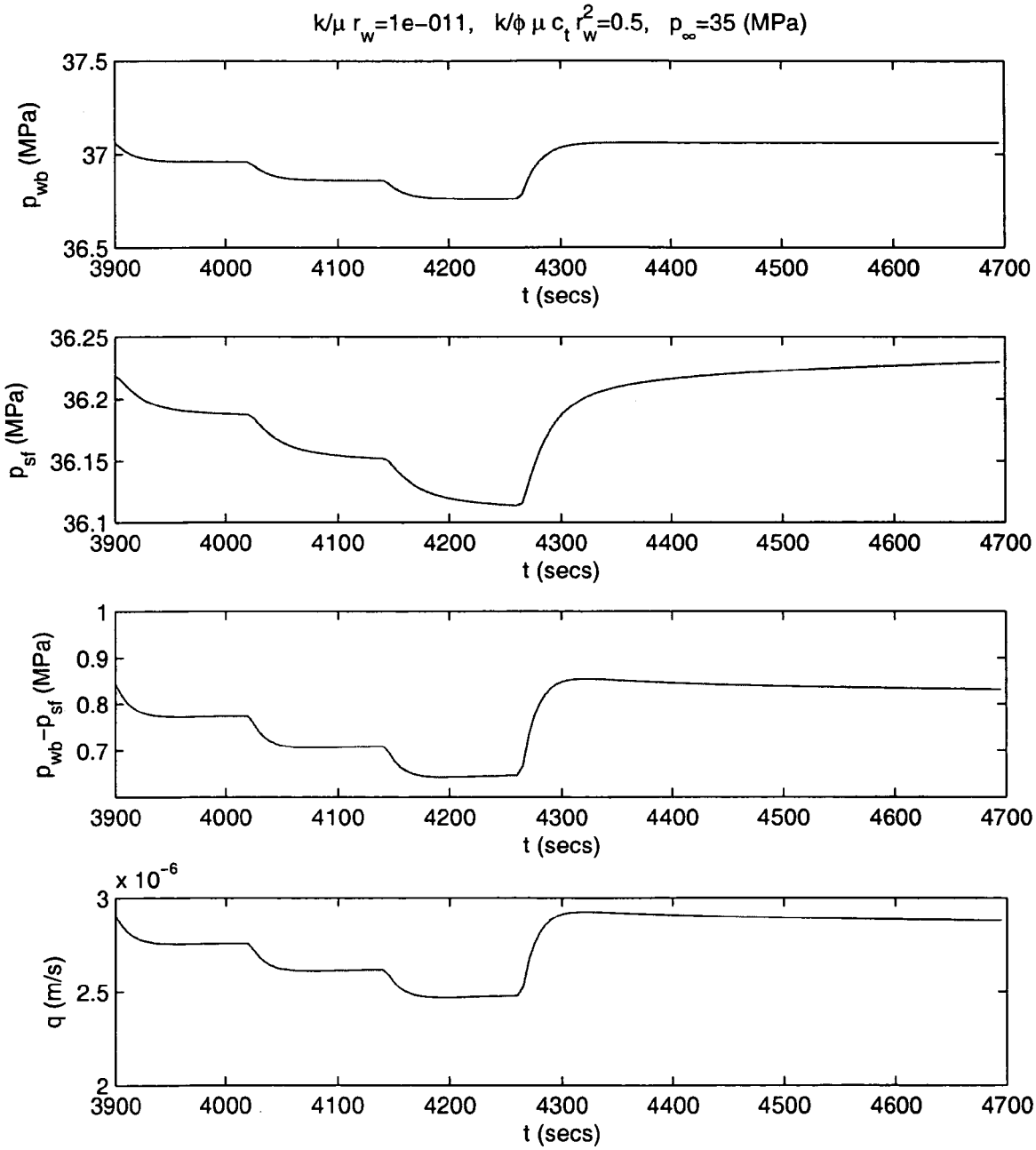
FIG. 9 shows graphs plotting simulated wellbore and sandface pressure data supplied to the model of FIG. 8, together with graphs plotting pressure difference and leak-off rate data.

The supercharge estimation method outlined above was applied to simulated data. FIGS. 7 and 8 show graphs summarising the filtration process prior to and during the measurement sequence, which was from t=3900 seconds to t=4700 seconds. FIG. 7 shows the wellbore conditions, and FIG. 8 shows the results from a forward simulation of filtration predicted by the model. FIG. 9 shows graphs plotting the simulated wellbore and sandface pressure data supplied to the model together with graphs plotting pressure differential across the filter cake and leak-off rate data.

FIG. 7 mainly shows inputs to the computation of leak-off and formation pressure. The top track shows the depth of the drill bit below to the formation to be measured (the pressure measurement tool is located 100 ft above the bit); the second track shows the drilling fluid circulation rate, which falls to zero at around 1300 seconds when a drill pipe connection is made; in the third track the solid line shows the pressure in the wellbore, and the broken line the pressure in the formation at great distances, $p_\infty$; the fourth track is the gap between the drill string and the sandface at the formation to be measured, this changes in time because the diameter of the drill string varies axially; the fifth track is the wall shear rate of the mud flow, which directly influences the filtrate leak-off rate; and the solid line in the sixth track shows the Reynolds number for the mud flow opposite the measurement formation while the broken line indicates the critical Reynolds number above which the flow in the mud is turbulent and thus when significant erosion of mud cake might be expected. The formation permeability was 1 mD, and the far formation pressure 35 MPa.

FIG. 8 shows outputs from the computation of leak-off and formation pressure. The top track shows a quantity proportional to the amount of solids in the filtercake, apart from the initial instants and the period of drill pipe connection, this does not vary in time indicating that a steady state of constant loss rate dynamic filtration has been set up; the second track shows the cumulative volume of filtrate lost into the formation; the third track is the differential pressure across the filtercake, $\Delta p$; the fourth track is the instantaneous desorptivity, $S(\Delta p)$; the fifth track is the filtrate leak off rate $q(t)$; and the sixth track is the difference between the sandface pressure and the formation pressure at great distances. At time t=4000 seconds, we see from the bottom graph of FIG. 8 that the sandface pressure is supercharged by about 1 MPa or 10 bars relative to the distant formation.

FIG. 9 expands scales, so as to focus in on the key outputs of the simulation during the period of pressure pulsation. The top track shows the wellbore pressure (as FIG. 6); the second track is the sandface pressure; the third track the differential pressure across the cake; and the fourth track the filtrate leak-off rate.

Figure 10:
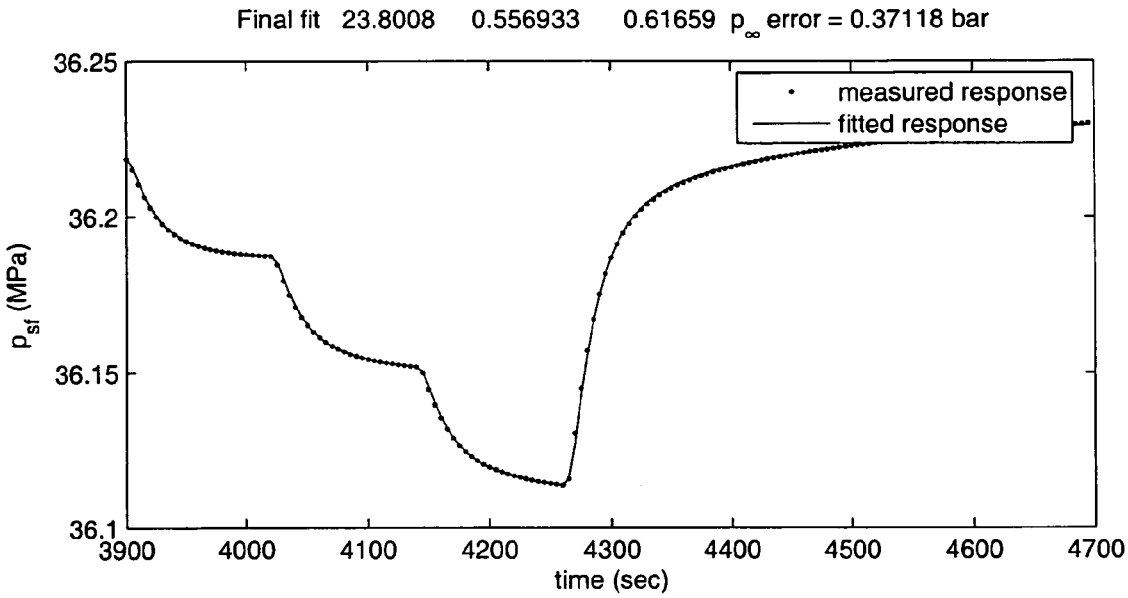
FIG. 10 shows in the upper graph an optimised fitted solution for the sandface pressure based on adjusted values of the parameters $\{A,\kappa,m\}$, and in the lower graph the sandface pressure evaluated with starting values of $\{A,\kappa,m\}$.
Figure 10:
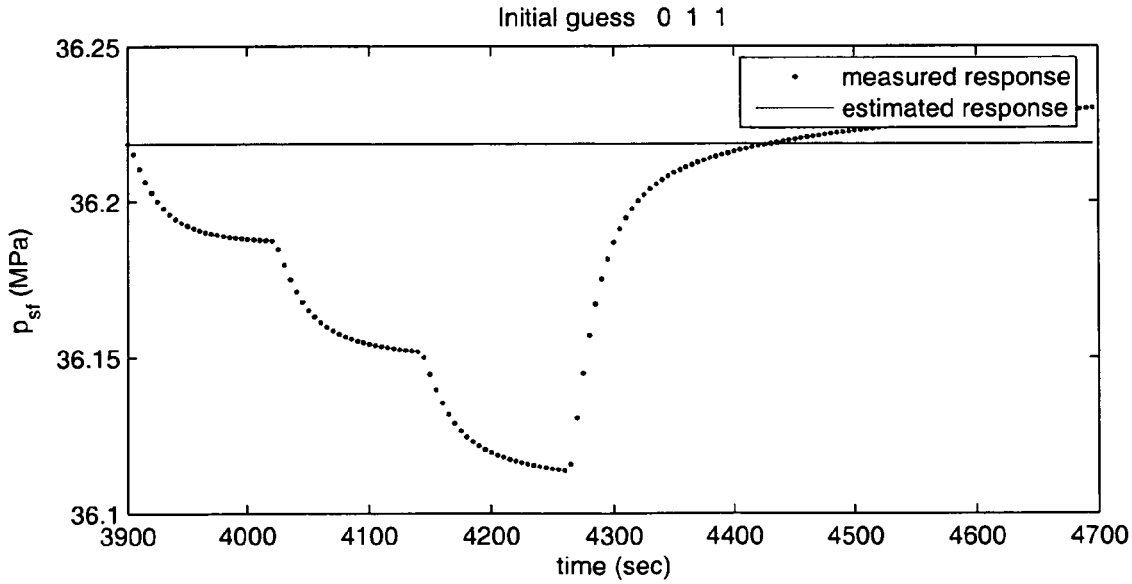

FIG. 10 shows in the upper graph the optimised fitted solution for the sandface pressure based on the adjusted values of the parameters $\{A,\kappa,m\}$, and in the lower graph the sandface pressure evaluated with the starting values of $\{A,\kappa,m\}$ The lower graph does not vary with time because the starting value of A was zero. The far field formation pressure (true value 350 bar) is over-estimated at the final fit by 0.37118 bar; that is, around 96% of the supercharge pressure is removed by the algorithm. The fitted values for the parameters $\kappa$ and m are 0.556933 and 0.61659 respectively; the true values were 0.5 and 0.6. The exact values of $\kappa$ and m are not recovered because the interpretation model is only an approximation to the true response, through equation (6) and through the approximations inherent in the use of sampled data (e.g. equation (18)).

Figure 11:
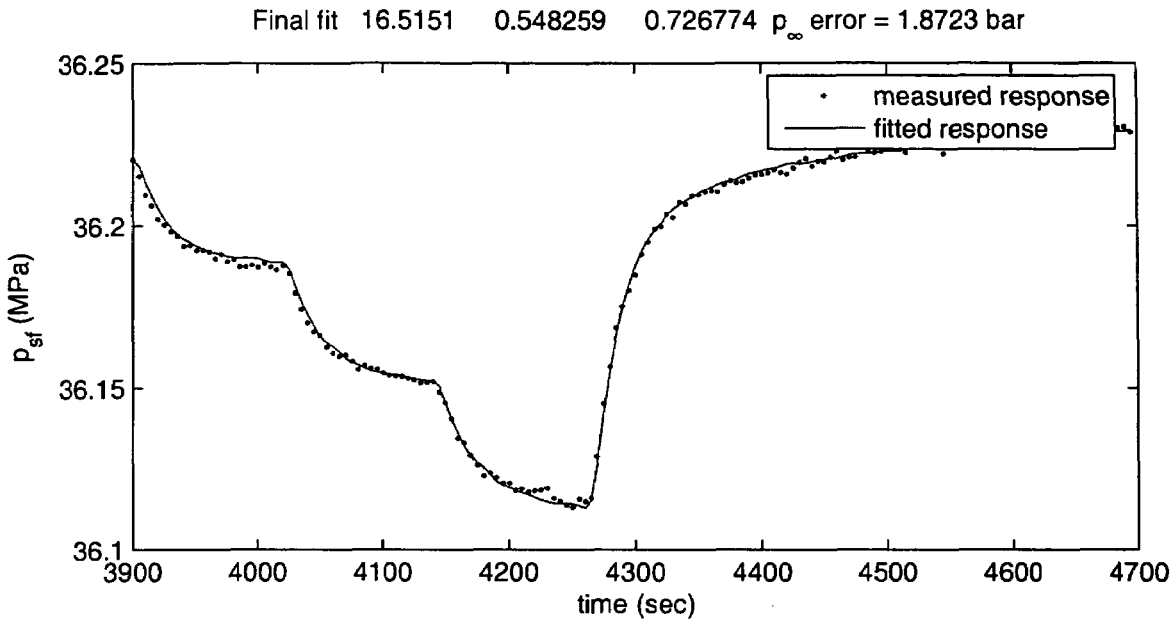
FIG. 11 shows in the upper graph an optimised fitted solution for the sandface pressure based on adjusted values of the parameters $\{A,\kappa,m\}$, and in the lower graph the sandface pressure evaluated with starting values of $\{A,\kappa,m\}$ after adding a Gaussian random error to the wellbore and sandface data of FIG. 9.
Figure 11:
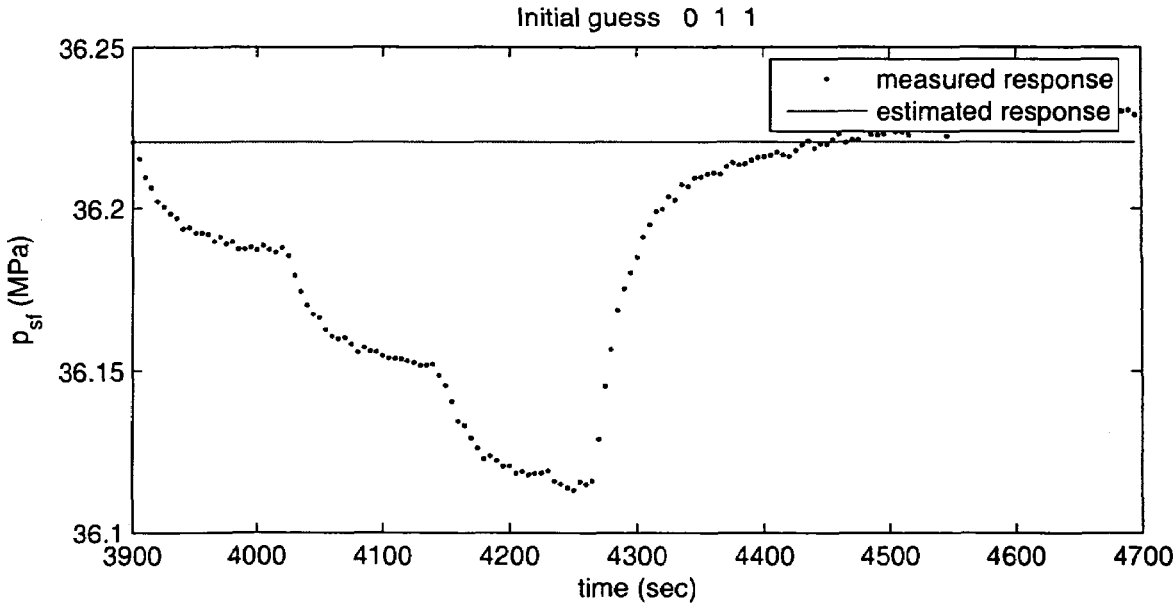

The result of adding a Gaussian random error, with zero mean and standard deviation 1000 Pa, to the wellbore and sandface input data streams is shown in FIG. 11, which again shows in the upper graph the optimised fitted solution for the sandface pressure based on the adjusted values of the parameters $\{A,\kappa,m\}$, and in the lower graph the sandface pressure evaluated with the starting values of $\{A,\kappa,m\}$. Again, the lower graph does not vary with time because the starting value of A was zero. Compared to the measured sandface pressure variations, this is a moderate noise amplitude. The fitted far field formation pressure is, in this particular realization, over-estimated by 1.8723 bar, and the fitted values for the parameters $\kappa$ and m are 0.548259 and 0.726774. While noise worsens the estimate of formation pressure, it does not lead, at this noise amplitude, to unreasonable results.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

Mathematical Appendix

Large and small time asymptotics for R and H:

$$R_D(\tau) = \frac{4}{\pi}\int_0^\infty \frac{e^{-\tau u^2}}{u(J_1^2(u)+Y_1^2(u))}\,du \sim \begin{cases} \sqrt{\pi/\tau} & \tau << 1 \\ \pi/(2\tau) & \tau >> 1 \end{cases}, \tag{19}$$

and $$H_D(\tau) = \frac{4}{\pi}\int_0^\infty \frac{(1-e^{-\tau u^2})}{u^3(J_1^2(u)+Y_1^2(u))}\,du \sim \begin{cases} 2\sqrt{\pi\tau} & \tau << 1 \\ (\pi/2)\log\tau & \tau >> 1 \end{cases}. \tag{20}$$

Treatment of infinite range in integration:

$$\int_0^\infty f(u)\,du = \int_0^{\pi/2} f(\tan\theta)\sec^2\theta\,d\theta. \tag{21}$$

Discretization of convolution integral: Write $$f(t')=\Delta p(t')-\Delta p(0)^m,$$

and put $$I(t) = \kappa\int_0^t R_D(\kappa(t-t'))\,f(t')\,dt'. \tag{22}$$

Discretizing the range of integration, and replacing f(t') on each panel of the mesh by the average of its values at the panel edges, we obtain $$I(t_j) \approx \sum_{i=1}^{j-1} \kappa\int_{t_i}^{t_{i+1}} R_D(\kappa(t_j-t'))\,dt'\,\frac{f(t_{i+1})+f(t_i)}{2}. \tag{23}$$

However, $$\begin{aligned}\kappa\int_{t_i}^{t_{i+1}} R_D(\kappa(t_j-t'))\,dt' &= \kappa\int_{t_i}^{t_j} R_D(\kappa(t_j-t'))\,dt' - \\ &\quad \kappa\int_{t_{i+1}}^{t_j} R_D(\kappa(t_j-t'))\,dt' \\ &= H_D(\kappa(t_j-t_i)) - H_D(\kappa(t_j-t_{i+1})).\end{aligned} \tag{24}$$

so $$I(t_j) \approx \frac{f(t_2)}{2}H_D(\kappa(t_j-t_1)) + \sum_{i=2}^{j-1}\frac{f(t_{i+1})-f(t_{i-1})}{2}H_D(\kappa(t_j-t_i)) \tag{25}$$

where we have used $H_D(0)=0$ and $f(0)=0$ to drop a few terms.

Derivatives for Jacobian, used in optimisation:

The residual is given by $$\varepsilon(t_j) = p_{sf}(t_j) - p_{sf}(0) - A\left[\begin{array}{l}\Delta p(0)^m(H_D(\kappa(t_j+t_0)) - H_D(\kappa t_0)) + \\ \frac{(\Delta p(t_2)^m - \Delta p(t_1)^m)}{2}H_D(\kappa(t_j-t_1)) + \\ \sum_{i=2}^{j-1}\frac{\Delta p(t_{i+1})^m - \Delta p(t_{i-1})^m}{2}H_D(\kappa(t_j-,\end{array}\right. \tag{26}$$

and so $$\frac{\partial\varepsilon}{\partial A} = -\left[\begin{array}{l}\Delta p(0)^m(H_D(\kappa(t_j+t_0)) - H_D(\kappa t_0)) + \\ \frac{(\Delta p(t_2)^m - \Delta p(t_1)^m)}{2}H_D(\kappa(t_j-t_1)) + \\ \sum_{i=2}^{j-1}\frac{\Delta p(t_{i+1})^m - \Delta p(t_{i-1})^m}{2}H_D(\kappa(t_j-t_i))\end{array}\right], \tag{27}$$

-continued $$\frac{\partial\varepsilon}{\partial\kappa} = -A\left[\begin{array}{l}\Delta p(0)^m((t_j+t_0)R_D(\kappa(t_j+t_0)) - tR_D(\kappa t_0)) + \\ \frac{(\Delta p(t_2)^m - \Delta p(t_1)^m)}{2}(t_j-t_1)R_D(\kappa(t_j-t_1)) + \\ \sum_{i=2}^{j-1}\frac{\Delta p(t_{i+1})^m - \Delta p(t_{i-1})^m}{2}(t_j-t_i)R_D(\kappa(t_j-t_i))\end{array}\right], \tag{28}$$

and $$\frac{\partial\varepsilon}{\partial m} = -A\left[\begin{array}{c}\log(\Delta p(0))\,\Delta p(0)^m(H_D(\kappa(t_j+t_0)) - H_D(\kappa t_0)) + \\ \frac{(\log(\Delta p(t_2))\,\Delta p(t_2)^m - \log(\Delta p(t_1))\,\Delta p(t_1)^m)}{2} \\ H_D(\kappa(t_j-t_1)) + \sum_{i=2}^{j-1} \\ \frac{\log(\Delta p(t_{i+1}))\,\Delta p(t_{i+1})^m - \log(\Delta p(t_{i-1}))\,\Delta p(t_{i-1})^m}{2} \\ H_D(\kappa(t_j-t_i))\end{array}\right]. \tag{29}$$

It is advantageous to scale all variables so that all quantities used in the optimisation are order 1.

Model Enhancements Appendix

A high-level generalization of the methodology presented above can be made so as to demonstrate how multiphase flows within the formation, and more complex models for filtercake behaviour, could be treated. A multiphase interpretation is needed if, for example, supercharging due to water based mud invasion into a hydrocarbon bearing zone must be corrected. A different model for the filtercake could be required if, for example, the internal adjustment timescale of the cake was not short compared with the time scale of pressure pulsing.

Analogous to (1) we have $$p_{sf}(t) = p_\infty + \underset{-t_0\le t'\le t}{M}[q(t');\lambda]. \tag{30}$$

where M denotes a non-linear functional of the entire past flow rate history and λ denotes a set of parameters describing formation fluid mobilities, capillary pressures and the like. In practice, M would be implemented as a numerical solution of the coupled formation pressure and saturation equations, using for example the core solver code of a reservoir simulation software. The sandface injection flow rate is the main, driving, input.

Some statement about filtrate loss rate history during the period prior to testing must be supplied, for example in while-drilling applications the approximation $$q_{history}(t')=q(0) \text{ for } -t_0\le t'\le t, \tag{31}$$

analogous to (6) can be made.

For wireline applications, because of the extended period prior to measurement when the drilling fluid is not circulating and hence the filtrate leak-off rate is decaying as the mudcake grows in thickness, a different approximation is necessary. We might, for example set $$q_{history}(t') = \begin{cases}\frac{q(0)t_*^{1/2}}{(t_*-t_1)^{1/2}} & \text{for } -t_0 < t' \le -t_1 \\ \frac{q(0)t_*^{1/2}}{(t'+t_*)^{1/2}} & \text{for } -t_1 < t' \le 0\end{cases} \tag{32}$$

for $-t_0 \le t' \le t$, where $-t_l$ is the (known) time at which drilling fluid circulation past the formation of interest ceases, and $t_*$ is an adjustable parameter. The key ideas in (32) are: a) during drilling fluid circulation the leak-off rate can be taken as constant in time, b) once the circulation ceases the leak off rate decays with a suitably arranged square root of time power law, and c) the leak-off rate does not change discontinuously at the instant of cessation of circulation. All these concepts are reasonable reflections of the observed phenomena of wellbore filtration, which are discussed in E. J. Fordham, D. F. Allen & H. K. J. Ladva "The Principle of a Critical Invasion Rate and its Implications for Log Interpretation" SPE paper 22539, (1991). In both (31) and (32), during the parameter fitting q(0) is treated as an adjustable parameter whose value is to be determined. The value of $t_*$ in (32) is also so determined.

A further enhancement to the approximation of fluid loss history while-drilling is possible if the time histories of drilling fluid circulation rate and bit position are available, and the geometry of the drill-string and bottom hole assembly, and the rheology of the drilling fluid are known. In this case, using the bit position and drill string geometry information it is possible to compute the geometry of the mud flow path in the annulus between drill string and formation or casing as a function of time. Using this information, the mud flow rate and the mud rheology, the wall shear stress exerted by the flowing mud at the wellbore wall at the measurement formation $\tau_w(t)$ can also be determined at all times, as can the wall shear rate $\dot{\gamma}(t)$ (the wall shear stress is closely related to the frictional component of the axial pressure gradient, which is routinely computed in drilling hydraulics calculations). Using this information, the filtrate leak off rate during periods of drilling fluid circulation can be approximated as $$q_{history}(t') = q(0)\left(\frac{\tau_w(t')}{\tau_w(0)}\right)^r \text{ for } -t_0 \le t' \le t \tag{33}$$

(Fordham et. al., SPE 22539, refers to data indicating an approximately linear dependence of loss rate on wall shear stress). The parameter r could be taken from laboratory measurements on the drilling fluid, or treated as a parameter to be fitted along with q(0) etc. We note that a formula analogous to (33) can be written, in terms of the wall shear rate $\dot{\gamma}(t)$. Also, the while-circulating part of equation (32) can be generalized to include hydraulics dependence as in (33).

Returning to the model for filtrate loss rate during pressure pulsing, we again relate the loss rate to the pressure differential across the cake, and generalize (12), permitting a dependence on recent past history i.e. on occurrences during the pressure pulsation sequence. We set $$q(t) = q(0) + \underset{0\le t''\le t}{B}(\Delta p(t'') - \Delta p(0); \eta) \tag{34}$$

where B denotes a non-linear function of the past history of differential pressure across the cake during pulsation, and $\eta$ denotes a set of parameters describing cake compactability, hydraulic resistance, internal relaxation timescales, and the like. In practice, B might be implemented as a numerical solution of the partial differential equations governing cake compaction (as reviewed in J. D. Sherwood & G. H. Meeten "The filtration properties of compressible mud filtercakes" Journal of Petroleum Science and Engineering, vol. 18, 73-81 (1997)), or through some less complicated stimulus-response model developed especially for the present purpose.

Lastly, elimination of $p_\infty$, and use of (34) gives $$p_{sf}(t) - p_{sf}(0) = \underset{-t_0\le t'\le t}{M}\left[\begin{cases} q_{history}(t') & -t_0 \le t' < 0 \\ q(0) + \underset{0\le t''\le t'}{B}(\Delta p(t'') - \Delta p(0); \eta & 0 \le t' \le t \end{cases}; \lambda\right] - \underset{-t_0\le t'\le 0}{M}[q_{history}(t'); \tag{35}$$

which is analogous to (14). $q_{history}(t')$ is given by (31), (32) or (33), as appropriate. The values of the parameters $\{q(0),\eta,\lambda\}$ (and $t_*$ in the wireline case, and possibly r if hydraulics history data is available) are determined as before, through minimization of the sum of squared residuals when fitting to wellbore and sandface pressure data streams.

Once parameter fitting has been completed, the far-field formation pressure is estimated as $$p_\infty = p_{sf}(0) - \underset{-t_0\le t'\le 0}{M}\lfloor q_{history}(t'); \lambda\rfloor, \tag{36}$$

which is analogous to (8).

Those knowledgeable in the field will recognize that a considerable number of elaborations can be made to the various models outlined here, without departing from the basic spirit of the methodology disclosed. A variant of the above example has been presented by the inventor as SPE paper 95710 ("Correcting Supercharging in Formation-Pressure Measurements Made While Drilling") during the 2005 SPE Annual Technical Conference and Exhibition in Dallas, Tex., U.S.A, 9-12 Oct. 2005, providing a simplified method of fitting the parameters.

The invention claimed is:

1. A method for estimating the amount of supercharging in a formation penetrated by a wellbore, the method comprising the steps of:

obtaining measurements of pressure fluctuations at a position in the formation accessible from the well bore and at an adjacent position in the wellbore;

in a computer, providing a formation flow model which relates variations in pressure with time at said positions to one or more adjustable parameters from which the amount of supercharging can be estimated, at least one of the one or more adjustable parameters accounting for the influence on fluid flow of a wellbore filter cake layer and/or the influence on fluid flow of the formation, wherein the model is a forward model accounting for the drilling history of the wellbore;

adjusting the one or more adjustable parameters to provide a best fit between the pressure variations predicted by the model and the measured pressure fluctuations; and estimating the amount of supercharging from the one or more adjustable parameters thus-adjusted.

2. A method according to 1 wherein the fit between the pressure variations predicted by the model and the measured pressure fluctuations is assessed in the time domain.

3. A method according to claim 1, wherein the pressure fluctuations are measured over a time interval of at most 30 minutes.

4. A method according claim 1, wherein said position in the formation is at the sandface of the wellbore.

5. A method according claim 1, wherein the pressure measured in the wellbore is the wellbore fluid pressure.

6. A method according to claim 1 wherein the obtaining step includes providing a measuring tool in the wellbore to measure the pressure fluctuations.

7. A method according to claim 6, wherein the measuring tool is attached to a drill string.

8. A method according to claim 6, wherein the measuring tool is attached to a wireline.

9. A method according to claim 6, further comprising the step of inducing said pressure fluctuations.

10. A method according to claim 6, wherein said model is provided on a downhole computing system, and the method further comprises the step of transmitting a signal representing the estimated amount of supercharging from the computing system to the surface.

11. A method according to claim 6, wherein said model is provided on a surface computing system, and the method further comprises the step of transmitting a signal representing the measured pressure fluctuations from the measuring tool to the computing system.

12. A method for estimating the amount of supercharging in a formation penetrated by a wellbore, the method comprising the steps of:

obtaining measurements of pressure fluctuations at a position in the formation accessible from the well bore and at an adjacent position in the wellbore;

in a computer, providing a formation flow model which relates variations in pressure with time at said adjacent positions to one or more adjustable parameters from which the amount of supercharging can be estimated, wherein the model is a forward model accounting for the drilling history of the wellbore; and adjusting the one or more adjustable parameters to provide a best fit between the pressure variations predicted by the model and the measured pressure fluctuations, wherein the fit between the measured pressure fluctuations and the pressure difference variations predicted by the model is assessed in the time domain; and estimating the amount of supercharging from the one or more adjustable parameters thus-adjusted.

13. A computer system for estimating the amount of supercharging in a formation penetrated by a wellbore, the system comprising:

an input device for receiving pressure fluctuation measurements obtained at a position in the formation accessible from the well bore and at an adjacent position in the wellbore, wherein the received pressure fluctuation measurements are measured over a time interval of at most 30 minutes;

a memory device carrying a formation flow model which relates variations in pressure with time at these positions to a plurality of adjustable parameters from which the amount of supercharging can be estimated, at least one of the plurality of adjustable parameters accounting for the influence on fluid flow of a wellbore filter cake layer and/or the influence on fluid flow of the formation; and a processor for optimally fitting the pressure variations predicted by the model to the measured pressure fluctuations by adjustment of said plurality of adjustable parameters, and estimating the amount of supercharging from the adjusted plurality of adjustable parameters.

14. An apparatus for estimating the amount of supercharging in a formation penetrated by a wellbore, the apparatus comprising a measuring tool for measuring downhole pressure fluctuations at a position in a formation accessible from a wellbore and an adjacent position in the wellbore, and a computer system according to claim 13 for estimating the amount of supercharging based on the pressure fluctuations measured by the measuring tool.

15. A computer system for estimating the amount of supercharging in a formation penetrated by a wellbore, the system comprising:

an input device for receiving pressure fluctuation measurements obtained at a position in the formation accessible from the well bore and at an adjacent position in the wellbore, wherein the received pressure fluctuation measurements are measured over a time interval of at most 30 minutes;

a memory device carrying a formation flow model which relates variations in pressure with time at these positions to a plurality of adjustable parameters from which the amount of supercharging can be estimated; and a processor for optimally fitting the pressure variations predicted by the model to the measured pressure fluctuations by adjustment of said plurality of adjustable parameters, and estimating the amount of supercharging from the adjusted plurality of adjustable parameters, the fit between the measured pressure fluctuations and the pressure difference variations predicted by the model being assessed in the time domain.

* * * * *